US010251239B2

(12) United States Patent
Bian et al.

(10) Patent No.: US 10,251,239 B2
(45) **Date of Patent: *Apr. 2, 2019**

(54) ILLUMINATING DEVICE, CONTROL METHOD THEREOF AND CONTROL SYSTEM THEREOF

(71) Applicant: OPPLE LIGHTING CO., LTD., Shanghai (CN)

(72) Inventors: Juan Bian, Shanghai (CN); Jie He, Shanghai (CN); Yang Hu, Shanghai (CN); Jian Wang, Shanghai (CN); Liang Wang, Shanghai (CN); Wei Wen, Shanghai (CN); Wanghui Yan, Shanghai (CN); Tianhang Zheng, Shanghai (CN); Zhixian Zhou, Shanghai (CN)

(73) Assignee: OPPLE LIGHTING CO., LTD., Shanghai (CN)

( * ) Notice: Subject to any disclaimer, the term of this patent is extended or adjusted under 35 U.S.C. 154(b) by 0 days.

This patent is subject to a terminal disclaimer.

(21) Appl. No.: 15/680,982

(22) Filed: Aug. 18, 2017

(65) Prior Publication Data

US 2017/0347425 A1 Nov. 30, 2017

Related U.S. Application Data

(63) Continuation of application No. PCT/CN2016/085042, filed on Jun. 7, 2016.

(30) Foreign Application Priority Data

Jun. 8, 2015 (CN) ..... 2015 1 0309709
Jun. 8, 2015 (CN) ..... 2015 1 0310386
(Continued)

(51) Int. Cl.
*H05B 37/02* (2006.01)
*H05B 33/08* (2006.01)

(52) U.S. Cl.
CPC ..... *H05B 37/02* (2013.01); *H05B 33/086* (2013.01); *H05B 33/0857* (2013.01); *H05B 33/0872* (2013.01)

(58) Field of Classification Search
CPC ..... H05B 33/0857; H05B 33/0842; H05B 33/086; H05B 37/02
See application file for complete search history.

(56) References Cited

U.S. PATENT DOCUMENTS 7,990,083 B2 8/2011 Deurenberg et al.
8,342,719 B2 1/2013 Takase
(Continued)

FOREIGN PATENT DOCUMENTS

CN 1781135 A 5/2006
CN 1841164 10/2006
(Continued)

OTHER PUBLICATIONS

International Search Report (including English translation) issued in corresponding International Application No. PCT/CN2016/085042, dated Aug. 24, 2016, 9 pages.
(Continued)

*Primary Examiner* — Thuy V Tran
(74) *Attorney, Agent, or Firm* — Arch & Lake LLP

(57) ABSTRACT

Embodiments of the present disclosure disclose an illuminating device, a control method thereof and a control system thereof, which can precisely adjust the color of irradiating light according to the color of an object. In the embodiment of the present disclosure, a next detection light is obtained according to reflected light of a previous detection light. When the color difference of reflected light of the previous
(Continued)

detection light and the next detection light is less than a preset color difference range, the illuminating device is controlled to project the next detection light to an illuminated object.

20 Claims, 12 Drawing Sheets

(30) Foreign Application Priority Data

| | | |
|---|---|---|
| Jun. 8, 2015 | (CN) | 2015 1 0310390 |
| Jun. 8, 2015 | (CN) | 2015 1 0310418 |
| Jun. 8, 2015 | (CN) | 2015 2 0389892 U |
| Jun. 8, 2015 | (CN) | 2015 2 0390836 U |
| Jun. 8, 2015 | (CN) | 2015 2 0390860 U |
| Jun. 8, 2015 | (CN) | 2015 2 0394488 U |

(56) References Cited

U.S. PATENT DOCUMENTS

| | | | | |
|---|---|---|---|---|
| 8,403,523 | B2 | 3/2013 | Gerlach et al. | |
| 9,345,099 | B2 | 5/2016 | Baaijens et al. | |
| 2004/0218387 | A1 | 11/2004 | Gerlach | |
| 2008/0238339 | A1 | 10/2008 | Deurenberg et al. | |
| 2009/0086192 | A1* | 4/2009 | He | G01J 1/124 356/73 |
| 2010/0188022 | A1 | 7/2010 | Gerlach et al. | |
| 2010/0327764 | A1 | 12/2010 | Knapp | |
| 2012/0013255 | A1 | 1/2012 | Young | |
| 2013/0169796 | A1* | 7/2013 | Van Der Burgt | H05B 33/0866 348/135 |
| 2013/0214704 | A1 | 8/2013 | Gerlach et al. | |
| 2013/0293116 | A1 | 11/2013 | Carreras Molins | |
| 2013/0307419 | A1 | 11/2013 | Simonian | |
| 2014/0152188 | A1 | 6/2014 | Bora | |
| 2015/0230316 | A1 | 8/2015 | Baaijens et al. | |
| 2016/0100472 | A1 | 4/2016 | Baaijens et al. | |
| 2017/0111973 | A1* | 4/2017 | Chiang | H05B 33/0872 |

FOREIGN PATENT DOCUMENTS

| | | | |
|---|---|---|---|
| CN | 101167408 | A | 4/2008 |
| CN | 101283628 | A | 10/2008 |
| CN | 201340482 | Y | 11/2009 |
| CN | 102042549 | A | 5/2011 |
| CN | 102062638 | A | 5/2011 |
| CN | 102265620 | A | 11/2011 |
| CN | 102379002 | A | 3/2012 |
| CN | 102640569 | A | 8/2012 |
| CN | 102833485 | | 12/2012 |
| CN | 102858072 | A | 1/2013 |
| CN | 103299717 | A | 9/2013 |
| CN | 103470992 | A | 12/2013 |
| CN | 103857096 | A | 6/2014 |
| CN | 104100924 | A | 10/2014 |
| CN | 104344248 | A | 2/2015 |
| CN | 104486861 | A | 4/2015 |
| CN | 104488357 | A | 4/2015 |
| CN | 104913273 | A | 9/2015 |
| CN | 104913275 | A | 9/2015 |
| CN | 104918372 | A | 9/2015 |
| CN | 20704776 | U | 10/2015 |
| CN | 105101535 | A | 11/2015 |
| CN | 204929316 | U | 12/2015 |
| CN | 204943358 | U | 1/2016 |
| CN | 205142580 | U | 4/2016 |
| JP | 2007080533 | | 3/2007 |
| JP | 2011040241 | A | 2/2011 |
| WO | 2008081387 | A1 | 7/2008 |

OTHER PUBLICATIONS

Written Opinion issued in corresponding International Application No. PCT/CN2016/085042, dated Aug. 24, 2016, 5 pages.

Chinese Office Action (including English tranlation) issued in corresponding CN Patent Application No. 201510310436.5, dated Apr. 27, 2017, 8 pages.

Chinese Office Action (including English tranlation) issued in corresponding CN Patent Application No. 201510310418.7, dated Feb. 7, 2017, 10 pages.

Chinese Office Action (including English tranlation) issued in corresponding CN Patent Application No. 201510310418.7, dated Sep. 12, 2017, 8 pages.

Chinese Supplemental Search issued in corresponding CN Patent Application 201510310436.5, dated Jul. 26, 2017, 2 pages.

International Search Report (including English translation) issued in corresponding International Application No. PCT/CN2016/085043, dated Aug. 24, 2016, 9 pages.

Written Opinion (including English translation) issued in corresponding International Application No. PCT/CN2016/085043, dated Aug. 24, 2016, 13 pages.

Chinese Office Action (including English translation) issued in corresponding CN Patent Application No. 201510310418.7, dated Feb. 7, 2017, 10 pages.

Chinese Office Action (including English translation) issued in corresponding CN Patent Application No. 201510310436.5, dated Nov. 22, 2016, 9 pages.

* cited by examiner

ILLUMINATING DEVICE, CONTROL METHOD THEREOF AND CONTROL SYSTEM THEREOF

CROSS-REFERENCE TO RELATED APPLICATIONS

This application is based upon and claims the priority of PCT patent application No. PCT/CN2016/085042 filed on Jun. 7, 2016 which claims the priority of Chinese Patent Application No. 201520390836.7 filed on Jun. 8, 2015, Chinese Patent Application No. 201520389892.9 filed on Jun. 8, 2015, Chinese Patent Application No. 201510309709.4 filed on Jun. 8, 2015, Chinese Patent Application No. 201520390860.0 filed on Jun. 8, 2015, Chinese Patent Application No. 201510310386.0 filed on Jun. 8, 2015, Chinese Patent Application No. 201520394488.0 filed on Jun. 8, 2015, Chinese Patent Application No. 201510310390.7 filed on Jun. 8, 2015, and Chinese Patent Application No. 201510310418.7 filed on Jun. 8, 2015, the entire contents of all of which are hereby incorporated by reference herein for all purposes.

TECHNICAL FIELD

The present disclosure relates to the field of lighting technique, in particular to an illuminating device, a control method thereof and a control system thereof.

BACKGROUND

With the rapid development of lighting technique, illumination may not be confined to allow an illuminated object just to be illuminated, but may be escalated into a technique for enhancing the impression of the object by applying light effect in harmony with the color of the object to the illuminated object. The illuminating device can adaptively adjust the color of irradiating light of the illuminating device according to illuminated objects of different colors, so that the impression of the objects of different colors can all be enhanced. Thus, the illuminating device attracts the attention in the industry.

SUMMARY

The present disclosure discloses an illuminating device, a control method thereof and a control system thereof in order to adjust the color of emitted irradiating light according to the color of an object.

In the present disclosure, a control method of an illuminating device is provided. The control method may include controlling the illuminating device to project initial detection light to an illuminated object, in which the initial detection light is in an initial color; acquiring a color of initial reflected light generated by the illuminated object on the basis of the initial detection light; acquiring a target color according to the color of the initial reflected light; controlling the illuminating device to project target detection light to the illuminated object, in which the target detection light is in a target color; acquiring a color of target reflected light generated by the illuminated object on the basis of the target detection light; and determining whether the color difference between the initial reflected light and the target reflected light is within a preset color difference range or not, if yes, controlling the illuminating device to keep projecting the target detection light.

In the present disclosure, a control system of an illuminating device is also provided. The control system may include: an emission control circuit for controlling the illuminating device to project initial detection light to the illuminated object, in which the initial detection light is in an initial color; a reflected light color acquiring circuit for acquiring a color of initial reflected light generated by the illuminated object on the basis of the initial detection light; a target color acquiring circuit for acquiring a target color according to the color of the initial reflected light.

The control system may also include: the emission control circuit being used for controlling the illuminating device to project target detection light to the illuminated object, in which the color of the target detection light is the target color; the reflected light color acquiring circuit being used for acquiring a color of target reflected light generated by the illuminated object on the basis of the target detection light; a color difference determining circuit for determining whether the color difference between the initial reflected light and the target reflected light is within a preset color difference range; and the emission control circuit being used for controlling the illuminating device to keep projecting the target detection light when the color difference between the initial reflected light and the target reflected light is within the preset color difference range.

In the present disclosure, an illuminating device is further provided. The illuminating device may include: a light-emitting source; a power drive unit for adjusting the power supplied for the light-emitting source; and a control system that is electrically connected with the light-emitting source and the drive unit.

The control system of the illuminating device may include: an emission control circuit for controlling the illuminating device to project initial detection light to the illuminated object, in which the initial detection light is in an initial color; a reflected light color acquiring circuit for acquiring a color of initial reflected light generated by the illuminated object on the basis of the initial detection light; a target color acquiring circuit for acquiring a target color according to the color of the initial reflected light.

The control system of the illuminating device may further include: the emission control circuit being used for controlling the illuminating device to project target detection light to the illuminated object, in which the color of the target detection light is the target color; the reflected light color acquiring circuit being used for acquiring a color of target reflected light generated by the illuminated object on the basis of the target detection light; a color difference determining circuit for determining whether the color difference between the initial reflected light and the target reflected light is within a preset color difference range; and the emission control circuit being used for controlling the illuminating device to keep projecting the target detection light when the color difference between the initial reflected light and the target reflected light is within the preset color difference range.

It is to be understood that, both the foregoing general description and the following detailed description are exemplary and explanatory only and are not restrictive of the present disclosure.

BRIEF DESCRIPTION OF THE DRAWINGS

For more clear description of the technical proposals in the embodiments of the present disclosure, a brief description will be given below to the accompanying drawings required to be used in the description of the embodiments.

It is apparent that the accompanying drawings described below are only some embodiments of the present disclosure, and other drawings may also be obtained by an ordinary skill in the art without creative efforts according to the accompanying drawings.

Figure 1:
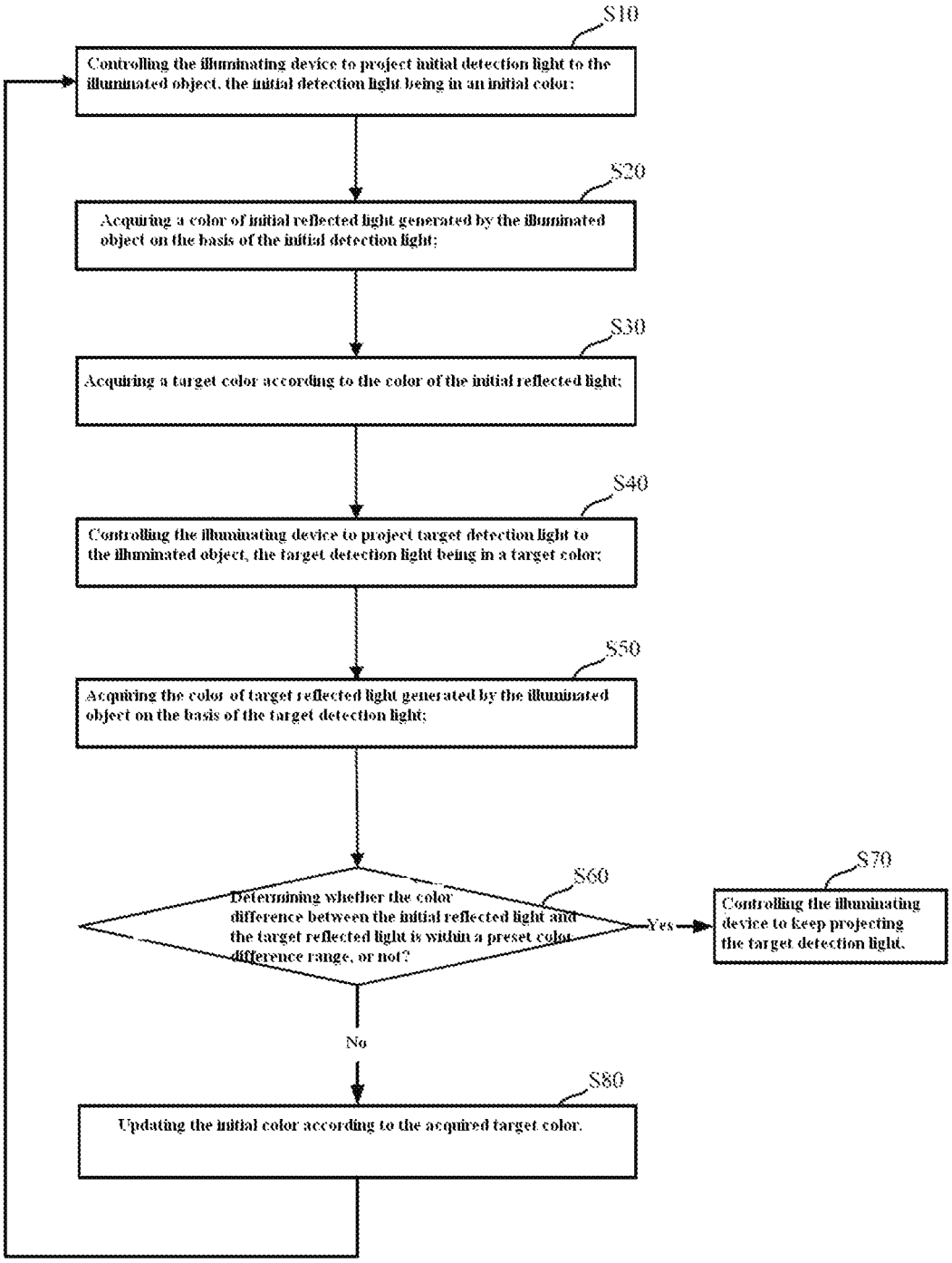
FIG. 1 is a flow chart of a control method of an illuminating device in an embodiment of the present disclosure.

Skilled artisans will appreciate that elements in the figures are illustrated for simplicity and clarity and have not necessarily been drawn to scale. For example, the dimensions and/or relative positioning of some of the elements in the figures may be exaggerated relative to other elements to help to improve understanding of various examples of the present disclosure. Also, common but well-understood elements that are useful or necessary in a commercially feasible example are often not depicted in order to facilitate a less obstructed view of these various examples. It will further be appreciated that certain actions and/or steps may be described or depicted in a particular order of occurrence while those skilled in the art will understand that such specificity with respect to sequence is not actually required. It will also be understood that the terms and expressions used herein have the ordinary technical meaning as is accorded to such terms and expressions by persons skilled in the technical field as set forth above, except where different specific meanings have otherwise been set forth herein.

DETAILED DESCRIPTION

Embodiments of the present disclosure provide an illuminating device, a control method thereof and a control system thereof.

For more clear understanding of the technical proposals in the present disclosure, clear and complete description will be given below to the technical proposals in the embodiments of the present disclosure with reference to the accompanying drawings in the embodiments of the present disclosure. It is apparent that the embodiments are only a part of but not all of embodiments of the present disclosure. Based on the described embodiments of the present disclosure, various other embodiments can be obtained by those of ordinary skill in the art without creative labor and those embodiments shall fall into the protection scope of the present disclosure.

The terminology used in the present disclosure is for the purpose of describing exemplary examples only and is not intended to limit the present disclosure. As used in the present disclosure and the appended claims, the singular forms "a," "an" and "the" are intended to include the plural forms as well, unless the context clearly indicates otherwise. It shall also be understood that the terms "or" and "and/or" used herein are intended to signify and include any or all possible combinations of one or more of the associated listed items, unless the context clearly indicates otherwise.

It shall be understood that, although the terms "first," "second," "third," etc. may be used herein to describe various information, the information should not be limited by these terms. These terms are only used to distinguish one category of information from another. For example, without departing from the scope of the present disclosure, first information may be termed as second information; and similarly, second information may also be termed as first information. As used herein, the term "if" may be understood to mean "when" or "upon" or "in response to" depending on the context.

Reference throughout this specification to "one embodiment," "an embodiment," "exemplary embodiment," or the like in the singular or plural means that one or more particular features, structures, or characteristics described in connection with an example is included in at least one embodiment of the present disclosure. Thus, the appearances of the phrases "in one embodiment" or "in an embodiment," "in an exemplary embodiment," or the like in the singular or plural in various places throughout this specification are not necessarily all referring to the same embodiment. Furthermore, the particular features, structures, or characteristics in one or more embodiments may be combined in any suitable manner.

In some examples, the color of the irradiating light emitted by the illuminating device is generally adaptively adjusted by the following steps:

S1: switching on the illuminating device to project detection light to an illuminated object, and acquiring a reflection spectrum of the illuminated object;

S2: obtaining a color index of the illuminated object according to the reflection spectrum;

S3: inquiring an irradiating light list according to the color index, and acquiring target irradiating light; and S4: controlling the illuminating device to project the target irradiating light to the illuminated object.

In which, as the color of the illuminated object is random, the number of possible color varieties of the illuminated object is huge, so it is unrealistic to provide one irradiating light with specific color to each color of the object. The irradiating light list in the step S2 may generally classify possible color ranges of the object into a plurality of color zones, and subsequently provide irradiating light with specific color to each color zone. The color zone of the illuminated object is obtained after acquiring a color index, then the target irradiating light is determined.

At least the following problems exist in the above examples:

as each color zone in the irradiating light list includes a variety of colors of different types, single irradiating light is bound to be unable to be coordinated with all the colors in the color zone, which results in a poor preciseness in the self-adaptive adjustment of the color of the irradiating light emitted by the illuminating device according to the irradiating light list.

Thus, in the process of adjusting the irradiating light emitted by the illuminating device by acquiring different colors of the illuminated object via the projection of the detection light, the problem of poor preciseness of adjusting the color of the irradiating light emitted by the illuminating device may occur. The embodiments of the present disclosure provide a control method of an illuminating device for solving the above problem. Detailed description is given below to the method with reference to the accompanying drawings.

FIG. 1 is a flow diagram of a control method of an illuminating device, provided by an embodiment of the present disclosure. An executive body of the control method may be a control circuit board mounted in the illuminating device. The control circuit board includes multiple elements, such as a micro control unit (MCU), and a sensor. The elements are electrically connected with a plurality of elements in the illuminating device, such as a light-emitting source, a power drive unit, and a possible power supply, by wired or wireless means.

In which, during the regular illumination of the illuminated object by the light-emitting source of the illuminating device, the control circuit board periodically starts the foregoing control method, so as to allow the irradiating light emitted by the light-emitting source of the illuminating device to be rapidly adjusted when the illuminated object is replaced.

The foregoing control method comprises the following steps.

S10: controlling the illuminating device to project initial detection light to the illuminated object, in which the color of the initial detection light is in an initial color.

In the embodiment of the present disclosure, the light-emitting source of the illuminating device may be adopted to project the initial detection light. In the process of starting the control method, the irradiating light originally emitted by the light-emitting source of the illuminating device is turned off in advance, and then the projection of the detection light is switched on.

Another independent auxiliary light-emitting source may also be disposed in the illuminating device. After the irradiating light originally emitted by the light-emitting source of the illuminating device is turned off, for the projection of the detection light through the auxiliary light-emitting source, the auxiliary light-emitting source is only required to be electrically connected with the drive unit and the power supply of the illuminating device. No further description will be given here.

In an embodiment of the present disclosure, the initial detection light may be white light, and the color temperature of the white light may be 2,000K-30,000K and may also be within a smaller range of 2,500-25,000K. As the white light has wider spectrum width and there is no interference of light of other colors currently, the reflected light of the illuminated object can be more accurately obtained.

The initial detection light may also adopt light of other colors except the white light, as long as the light-emitting source can emit detection light of preset color by obtaining a PWM signal or a drive current value. No further description will be given here.

No matter the light-emitting source of the illuminating device, or the independent auxiliary light-emitting source, a light-emitting diode (LED) may be used as the light source; light source paths formed by LED light sources of multiple colors are combined to form a mixed light array by using a RGB and RGBW light mixing mode; and the functions of dimming and color mixing can be achieved by using the drive unit to control the start and the brightness of the light source paths with the multiple colors.

No matter the light-emitting source of the illuminating device or another independent auxiliary light-emitting source, other types, such as TL lamps and halogen lamps may also be used. No further description will be given here.

S20: acquiring the color of initial reflected light generated by the illuminated object on the basis of the initial detection light.

In the embodiment of the present disclosure, a sensor facing the illuminated object may be disposed on the illuminating device, and the sensor is adopted to acquire the initial reflected light on the basis of the initial detection light, and convert the initial reflected light into RGB electrical signals for embodying color. This technology is known by an ordinary skill in the art. No further description will be given here.

S30: acquiring target color according to the color of the initial reflected light.

The color of the initial reflected light embodies the color of the illuminated object. The target color obtained according to the color of the initial reflected light is relevant to the color of the illuminated object, so that the subsequently emitted target detection light of which the color is the target color can be gradually coordinated with the illuminated object in color.

Figure 2:
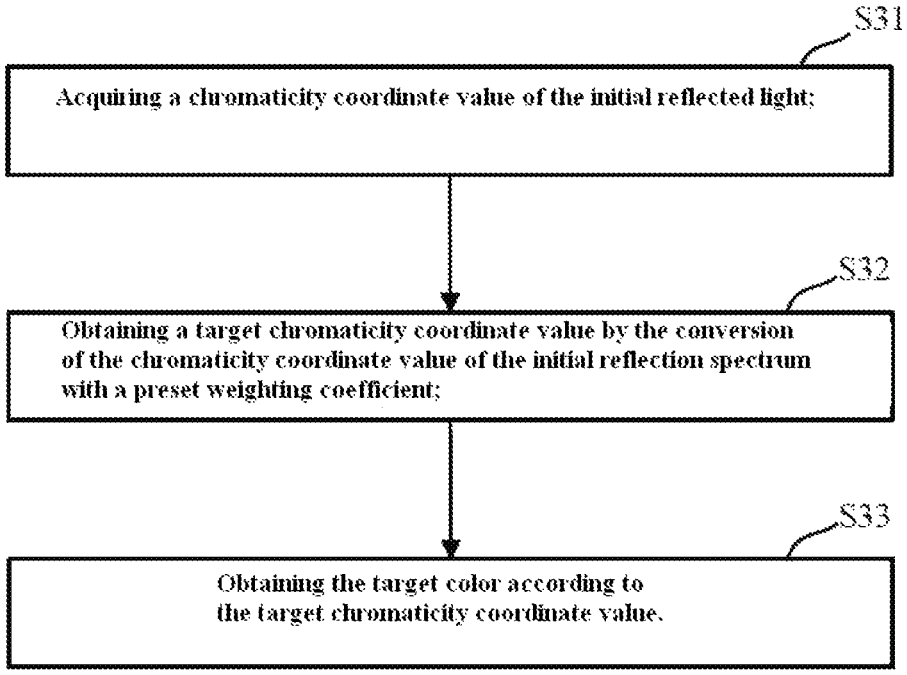
FIG. 2 is a specific flowchart illustrating a step of acquiring target color according to a color of the initial reflected light in a control method of an illuminating device, in an embodiment of the present disclosure.

With reference to FIG. 2, in an embodiment of the present disclosure, the step S30 specifically includes the following steps:

S31: acquiring a chromaticity coordinate value of the initial reflected light.

In the embodiment of the present disclosure, the chromaticity coordinate value corresponding to the RGB electrical signals may be obtained by the conversion of the RGB electrical signals of the initial reflected light acquired by the sensor. The technology is known by an ordinary skill in the art. No further description will be given here.

S32: obtaining a target chromaticity coordinate value by the conversion of the chromaticity coordinate value of the initial reflection spectrum with a preset weighting coefficient.

In the embodiment of the present disclosure, the control method of the illuminating device comprises two modes, namely a preset light sharing mode and a preset light filling mode.

In the preset light sharing mode, by adoption of the control method provided by the embodiment of the present disclosure, the irradiating light emitted by the illuminating device is adjusted to be basically consistent with the color of the illuminated object. For instance, when the color of the illuminated object is yellow, the irradiating light emitted by the illuminating device may be also adjusted to be yellow, so as to achieve the objective of positively embellishing the color of the illuminated object.

In the preset light filling mode, by adoption of the control method provided by the embodiment of the present disclosure, the irradiating light emitted by the illuminating device is adjusted to be basically opposite to the color of the illuminated object. For instance, when the color of the illuminated object is yellow, the irradiating light emitted by the illuminating device may be adjusted to be other colors, such as purple, which is the complementary color of the yellow color, so as to achieve the objective of negatively embellishing the color of the illuminated object.

Based on the color mixing theory in chromatics, no matter the preset light sharing mode or the preset light filling mode, the mutual coordination of the illuminated object and the irradiating light emitted by the illuminating device can be achieved by adjusting the color of the irradiating light emitted by the illuminating device, so that the illuminated object can be prominent. The technology is known by an ordinary skill in the art. No further description will be given here.

In an embodiment of the present disclosure, the step S32 specifically includes the following steps:

acquiring a target illumination mode, in which the target illumination mode is one of a preset light sharing mode and a preset light filling mode;

obtaining the target chromaticity coordinate value by increasing the chromaticity coordinate value of the initial reflection spectrum with the preset weighting coefficient, when the target illumination mode is the preset light sharing mode; and obtaining the target chromaticity coordinate value by decreasing the chromaticity coordinate value of the initial reflection spectrum with the preset weighting coefficient, when the target illumination mode is the preset light filling mode.

Since the reflected light has color attenuation with respect to the irradiating light, that is, the color of the reflected light obtained on the basis of certain irradiating light is clearly weaker than the irradiating light as the basis. In the preset light sharing mode, the target chromaticity coordinate value may be obtained by increasing the chromaticity coordinate value of the initial reflection spectrum with the preset weighting coefficient, so as to overcome the foregoing color attenuation. However, in the preset light filling mode, as the color of the irradiating light required by the preset light filling mode shall be opposite to the color of the illuminated object, the target chromaticity coordinate value must be obtained by decreasing the chromaticity coordinate value of the initial reflection spectrum with the preset weighting coefficient.

The foregoing preset weighting coefficient may be manually preset according to the degree of the preset light sharing mode, and the degree of the preset light filling mode, and the preset weighting coefficient required by the preset light sharing mode and the preset light filling mode may be set to be the same and may also be set to be different.

S33: obtaining the target color according to the target chromaticity coordinate value.

In the embodiment of the present disclosure, RGB electrical signals for embodying the target color may be obtained by the conversion of the chromaticity coordinate value, which is opposite to the process of obtaining the chromaticity coordinate value corresponding to the RGB electrical signals by the conversion of the RGB electrical signals of the initial reflected light acquired by the sensor. No further description will be given here.

S40: controlling the illuminating device to project target detection light to the illuminated object, in which the color of the target detection light is the target color.

In the embodiment of the present disclosure, a target PWM signal, or a target drive current value is obtained according to the target color, and subsequently the illuminating device is controlled to project the target detection light to the illuminated object according to the target PWM signal, or the target drive current value.

S50: acquiring the color of target reflected light generated by the illuminated object on the basis of the target detection light.

In the embodiment of the present disclosure, a sensor facing the illuminated object may be disposed on the illuminating device, and the sensor is adopted to acquire the target reflected light on the basis of the target detection light, and convert the target reflected light into RGB electrical signals for embodying color. The technology is known by an ordinary skill in the art. No further description will be given here.

S60: determining whether the color difference between the initial reflected light and the target reflected light is within a preset color difference range, or not? If yes, executing the step S70, and if no, executing the step S80.

In the embodiment of the present disclosure, whether the color difference between the initial reflected light and the target reflected light is within the preset color difference range is determined according to the difference of the chromaticity coordinate values of the initial reflected light and the target reflected light. The preset color difference range includes: the difference between the chromaticity coordinate value of the initial reflected light and the chromaticity coordinate value of the target reflected light is less than or equal to 0.001.

The preset color difference range is not limited to the above range of 0.001. The specific value of the preset color difference range may be set as required. No further description will be given here.

S70: controlling the illuminating device to keep projecting the target detection light.

According to the theory in chromatics, any irradiating light and the reflected light generated on the basis of the irradiating light are relevant to each other, and the range of the color of the irradiating light can be deducted by acquiring the color of the reflected light. As the color of the irradiating light cannot be acquired, whether the color difference of the initial detection light and the target detection light is close, or not, cannot be calculated. When the color difference between the initial reflected light and the target reflected light is within the preset color difference range, it can be apparently deducted that the color difference of the initial detection light and the target detection light is also very close.

No matter the preset light sharing mode, or the preset light filling mode, in the process of obtaining the target color in the step S30, the target color is always close to the color of the irradiating light mostly coordinated with the color of the illuminated object. When the color difference of the initial detection light and the target detection light is also close, it indicates that the color of the detection light does not change after the adjustment of the detection light for two adjacent times, then, it can be concluded that the detection light has been adjusted well. At this point, the color of the detection light is mostly coordinated with the color of the illuminated object.

S80: updating the initial color according to the acquired target color, and returning to the step S10.

When the color difference between the initial reflected light and the target reflected light is not within the preset range, it indicates that the color difference of the initial detection light and the target detection light is not very close, namely the detection light has not been adjusted well. Thus, the initial color is needed to be updated according to the currently acquired target color, and the steps S10 to S60 are executed again; and the target detection light is updated through the step S30, until a conclusion is obtained in the step S60 that the color difference between the initial reflected light and the target reflected light is within the preset range.

In the embodiment of the present disclosure, the required irradiating light may also be customized according to specific illumination requirement. For instance, irradiating light with preset color is provided for a certain garment, so as to obtain unique outstanding effect with distinctive personal features. The control method provided by the embodiment of the present disclosure may also be adopted to allow the irradiating light to be gradually close to the foregoing customized irradiating light, as long as the adjusting target of the irradiating light is only preset to be the customized irradiating light. No further description will be given here.

As can be seen from the technical proposals of the embodiments of the present disclosure, in the embodiment of the present disclosure, the next detection light is obtained according to reflected light of the previous detection light. When the color difference of reflected light of the previous detection light and the next detection light is less than a preset color difference range, the illuminating device is controlled to project the next detection light to an illuminated object. In this way, no matter how the color of the illuminated object changes, or even the color change is very subtle, a detection light of which the color is mostly coordinated with the illuminated object can also be automatically obtained to illuminate the object continuously.

Figure 3:
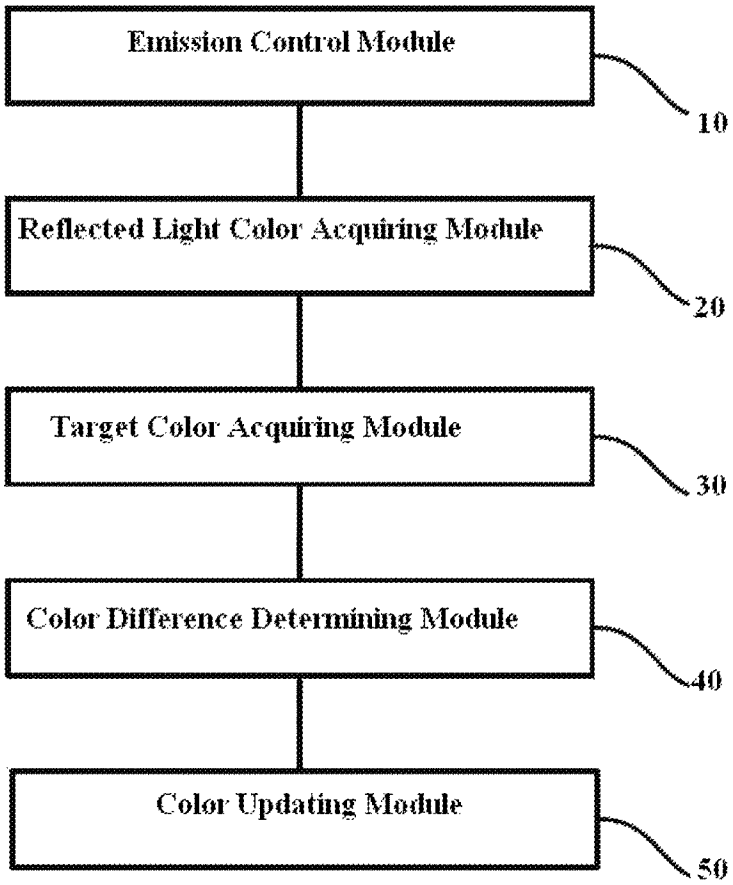
FIG. 3 is a block diagram of a control system of an illuminating device in an embodiment of the present disclosure.

FIG. 3 is a block diagram of a control system of an illuminating device, provided by an embodiment of the present disclosure. The control system may be operated by a control circuit board mounted in the illuminating device. The control circuit board is provided with multiple elements, such as a micro control unit (MCU), and a sensor. The elements are electrically connected with a plurality of elements in the illuminating device, such as a light-emitting source, a power drive unit, and a possible power supply, by wired or wireless means.

During the regular illumination of the illuminated object by the light-emitting source of the illuminating device, the control circuit board periodically starts the foregoing control method, so as to allow the irradiating light emitted by the light-emitting source of the illuminating device to be rapidly adjusted when the illuminated object is replaced.

The foregoing control system comprises the following modules.

An emission control module 10 is comprised for controlling the illuminating device to project initial detection light to the illuminated object, in which the initial detection light is in an initial color.

In an embodiment of the present disclosure, the light-emitting source of the illuminating device may be adopted to project the initial detection light. In the process of starting the control system, the irradiating light originally emitted by the light-emitting source of the illuminating device is turned off in advance, then the projection of the detection light is switched on.

Another independent auxiliary light-emitting source may also be disposed in the illuminating device. After the irradiating light originally emitted by the light-emitting source of the illuminating device is turned off, for the projection of the detection light through the auxiliary light-emitting source, the auxiliary light-emitting source is only required to be electrically connected with the drive unit and the power supply of the illuminating device. No further description will be given here.

In an embodiment of the present disclosure, the initial detection light may be white light, and the color temperature of the white light may be 2,000K-30,000K, or it may be within a smaller range of 2,500-25,000K. As the white light has wider spectrum width and there is no interference of light of other colors currently, the reflected light of the illuminated object can be more accurately obtained.

The initial detection light may also adopt light of other colors except the white light, as long as the light-emitting source can emit detection light of preset color by obtaining a PWM signal or a drive current value. No further description will be given here.

No matter the light-emitting source of the illuminating device or another independent auxiliary light-emitting source, a light-emitting diode (LED) may be used as the light source; light source paths formed by LED light sources of multiple colors are combined to form a mixed light array by utilization of RGB and RGBW light mixing mode; and the functions of dimming and color mixing can be achieved by adoption of the drive unit to control the start and the brightness of the light source paths with the multiple colors.

No matter the light-emitting source of the illuminating device or another independent auxiliary light-emitting source, other types, such as TL lamps and halogen lamps, may also be used. No further description will be given here.

A reflected light color acquiring module 20 is comprised for acquiring the color of initial reflected light generated by the illuminated object on the basis of the initial detection light.

In the embodiment of the present disclosure, a sensor facing the illuminated object may be disposed on the illuminating device, and the sensor is adopted to acquire the initial reflected light on the basis of the initial detection light, and convert the initial reflected light into RGB electrical signals for embodying color. This technology is known by an ordinary skill in the art. No further description will be given here.

A target color acquiring module 30 is comprised for acquiring target color according to the color of the initial reflected light.

The color of the initial reflected light embodies the color of the illuminated object. The target color obtained according to the color of the initial reflected light is relevant to the color of the illuminated object, so that the subsequently emitted target detection light of which the color is the target color can be gradually coordinated with the illuminated object in color.

Figure 4:
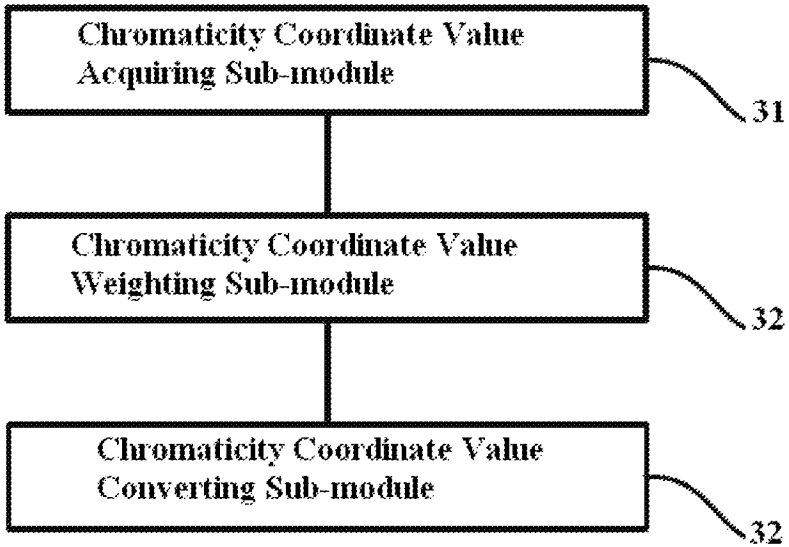
FIG. 4 is a block diagram of a target color acquiring module in a control system of an illuminating device in an embodiment of the present disclosure.

With reference to FIG. 4, in an embodiment of the present disclosure, the target color acquiring module 30 specifically includes the following modules.

A chromaticity coordinate value acquiring sub-module 31 is included for acquiring a chromaticity coordinate value of the initial reflected light.

In the embodiment of the present disclosure, the chromaticity coordinate value corresponding to the RGB electrical signals may be obtained by the conversion of the RGB electrical signals of the initial reflected light acquired by the sensor. The technology is known by an ordinary skill in the art. No further description will be given here.

A chromaticity coordinate value weighting sub-module 32 is included for obtaining a target chromaticity coordinate value by the conversion of the chromaticity coordinate value of the initial reflection spectrum with a preset weighting coefficient.

In an embodiment of the present disclosure, the control system of the illuminating device comprises two modes, namely a preset light sharing mode and a preset light filling mode.

In the preset light sharing mode, by adoption of the control system provided by the embodiment of the present disclosure, the irradiating light emitted by the illuminating device is adjusted to be basically consistent with the color of the illuminated object. For instance, when the color of the illuminated object is yellow, the irradiating light emitted by the illuminating device may be also adjusted to be yellow, so as to achieve the objective of positively embellishing the color of the illuminated object.

In the preset light filling mode, by adoption of the control system provided by the embodiment of the present disclosure, the irradiating light emitted by the illuminating device is adjusted to be basically opposite to the color of the illuminated object. For instance, when the color of the illuminated object is yellow, the irradiating light emitted by the illuminating device may be adjusted to be other colors, such as purple, which is the complementary color of yellow, so as to achieve the objective of negatively embellishing the color of the illuminated object.

Based on the color mixing theory in chromatics, no matter the preset light sharing mode, or the preset light filling mode, the mutual coordination of the illuminated object and the irradiating light emitted by the illuminating device can be achieved by adjusting the color of the irradiating light emitted by the illuminating device, so that the illuminated object can be prominent. This technology is known by an ordinary skill in the art. No further description will be given here.

In an embodiment of the present disclosure, the chromaticity coordinate value weighting sub-module 32 is specifically used to:

acquire a target illumination mode, in which the illumination mode is one of a preset light sharing mode, and a preset light filling mode;

obtain the target chromaticity coordinate value by increasing the chromaticity coordinate value of the initial reflection spectrum with the preset weighting coefficient, when the target illumination mode is the preset light sharing mode; and obtain the target chromaticity coordinate value by decreasing the chromaticity coordinate value of the initial reflection spectrum with the preset weighting coefficient, when the target illumination mode is the preset light filling mode.

Since the reflected light has color attenuation with respect to the irradiating light, that is, the color of the reflected light obtained on the basis of certain irradiating light is clearly weaker than the irradiating light as the basis. In the preset light sharing mode, the target chromaticity coordinate value may be obtained by increasing the chromaticity coordinate value of the initial reflection spectrum with the preset weighting coefficient, so as to overcome the foregoing color attenuation. However, in the preset light filling mode, as the irradiating light required by the preset light filling mode shall be opposite to the color of the illuminated object, the target chromaticity coordinate value is needed to be obtained by decreasing the chromaticity coordinate value of the initial reflection spectrum with the preset weighting coefficient.

The foregoing preset weighting coefficient may be manually preset according to the degree of the preset light sharing mode and the degree of the preset light filling mode, and the preset weighting coefficient required by the preset light sharing mode and the preset light filling mode may be set to be the same and may also be set to be different.

A chromaticity coordinate value converting sub-module 33 is included for obtaining the target color according to the target chromaticity coordinate value.

In the embodiment of the present disclosure, the RGB electrical signals for embodying the target color may be obtained by the conversion of the chromaticity coordinate value, which is opposite to the process of obtaining the chromaticity coordinate value corresponding to the RGB electrical signals by the conversion of the RGB electrical signals of the initial reflected light acquired by the sensor. No further description will be given here.

The emission control module 10 is also used for controlling the illuminating device to project target detection light to the illuminated object, in which the target detection light is in the target color.

In the embodiment of the present disclosure, a target PWM signal, or a target drive current value is obtained according to the target color, and subsequently the illuminating device is controlled to project the target detection light to the illuminated object according to the target PWM signal, or the target drive current value.

The reflected light color acquiring module 20 is also used for acquiring the color of target reflected light generated by the illuminated object on the basis of the target detection light.

In the embodiment of the present disclosure, a sensor facing the illuminated object may be disposed on the illuminating device, and the sensor is adopted to acquire the initial reflected light on the basis of the initial detection light, and convert the initial reflected light into RGB electrical signals for embodying color. This technology is known by an ordinary skill in the art. No further description will be given here.

A color difference determining module 40 is included for determining whether the color difference between the initial reflected light and the target reflected light is within a preset color difference range.

In the embodiment of the present disclosure, whether the color difference between the initial reflected light and the target reflected light is within the preset color difference range is determined according to the difference of the chromaticity coordinate values of the initial reflected light and the target reflected light. The preset color difference range includes: the difference between the chromaticity coordinate value of the initial reflected light and the chromaticity coordinate value of the target reflected light is less than or equal to 0.001.

The preset color difference range is not limited to the above range of 0.001. The specific value of the preset color difference range may be set as required. No further description will be given here.

The emission control module 10 is used for controlling the illuminating device to keep projecting the target detection light when the color difference between the initial reflected light and the target reflected light is within the preset color difference range.

According to the theory in chromatics, any irradiating light and the reflected light generated on the basis of the irradiating light are relevant to each other, and the range of the color of the irradiating light can be deducted by acquiring the color of the reflected light. As the color of the irradiating light cannot be acquired, whether the color difference of the initial detection light and the target detection light is close, or not, cannot be calculated. When the color difference between the initial reflected light and the target reflected light is within the preset color difference range, it can be apparently deducted that the color difference of the initial detection light and the target detection light is also very close.

No matter the preset light sharing mode, or the preset light filling mode, in the process of obtaining the target color in the step S30, the target color is always close to the color of the irradiating light mostly coordinated with the color of the illuminated object. When the color difference of the initial detection light and the target detection light is also close, it indicates that the color of the detection light does not change after the adjustment of the detection light for two adjacent times, then, it can be concluded that the detection light has been adjusted well. At this point, the color of the detection light is mostly coordinated with the color of the illuminated object.

A color updating module 50 is included for updating the initial color according to the acquired target color when the color difference between the initial reflected light and the target reflected light is not within the preset color difference range.

When the color difference between the initial reflected light and the target reflected light is not within the preset range, it indicates that the color difference of the initial detection light and the target detection light is not very close, namely the detection light has not been adjusted well. Thus, the initial color must be updated according to the currently acquired target color; the emission control module 10, the reflected light color acquiring module 20, the target color acquiring module 30 and the color difference determining module 40 execute the foregoing processes again; and the target detection light is updated through the target color acquiring module 30, until the conclusion that the color difference between the initial reflected light and the target reflected light is within the preset range is obtained in the color difference determining module 40.

In the embodiment of the present disclosure, in the control system, the reflected light color acquiring module 20, the target color acquiring module 30, the color difference determining module 40 and the color updating module 50 may be inter-communicated by wireless means, such as Bluetooth, WIFI, or ZigBee, or may be interconnected by wired means, such as a network cable, or a universal serial bus (USB).

The reflected light color acquiring module 20 may be integrated into the illuminating device and may be separated from the illuminating device.

Figure 5:
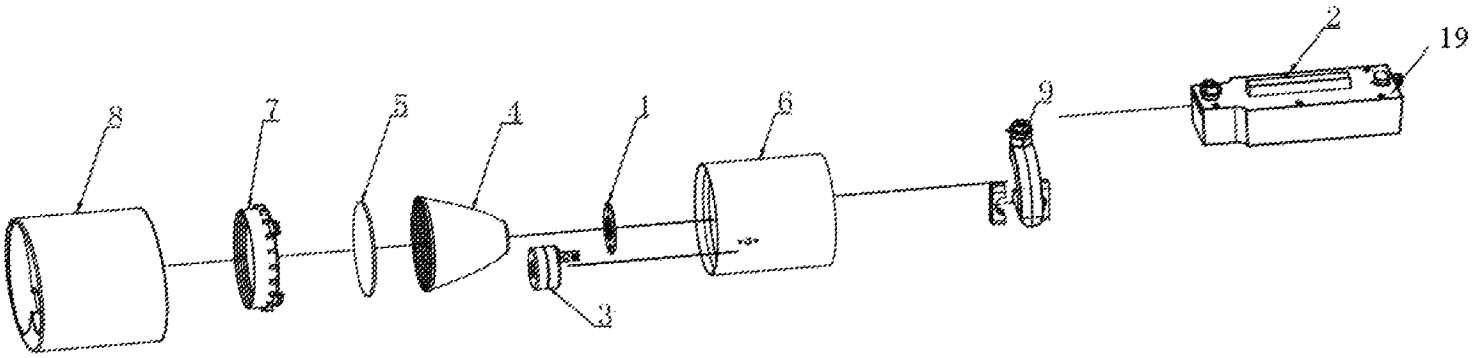
FIG. 5 is an assembly diagram of an illuminating device in an embodiment of the present disclosure.

As shown in FIG. 5 which is a schematic structural view of an illuminating device comprising the foregoing control system and employing the foregoing control method, the illuminating device comprises a light-emitting source 1, a reflecting shade 4, a transmitting shade 5, and a lamp body 6. The reflecting shade 4 covers the light-emitting source 1, and is expanded out towards the light exiting direction of the light-emitting source 1, so as to adjust or control the light-emitting direction of the light-emitting source 1. The transmitting cover 5 covers a light outlet of the reflecting shade 4 to form an optical control of final light emitting. A reflector holder 7 covers the transmitting shade 5 and is disposed on a light outlet of the lamp body 6, so as to fix components accommodated in the lamp body 6.

The illuminating device further comprises a sensor module 3 fixed on a side of the lamp body 6, and the detection direction of the sensor module is consistent with the light-emitting direction of the light-emitting source 1 and, is roughly parallel and level to the light outlet of the reflecting shade 4 and the transmitting shade 5. The sensor module 3 corresponds to the reflected light color acquiring module 20 of the control system, and is used for acquiring accurate color information of the illuminated object in real time, which includes initial color and target color. The illuminating device further comprises a control circuit board 2 for periodically starting the foregoing control method, so as to allow that the irradiating light emitted by the light-emitting source 1 of the illuminating device to be rapidly adjusted when the illuminated object is replaced.

A lamp body shade 8 is provided with an opening corresponding to the light-emitting direction of the reflecting shade 4 fixed on the reflector holder 7 and the detection direction of the sensor module 3, so as to provide convenience for light emitting and detection when simultaneously providing fixing, protection and aesthetic property by covering the outside of the lamp body 6 and the sensor module 3. A rotary support 9 is disposed at the rear of the lamp body 6 and connected with the control circuit board 2 and a power supply module 19. The sensor module 3 transmits data information of the illuminated object in the illumination direction of the light-emitting source 1, detected by the sensor module 3, to the control circuit board 2 through the rotary support 9; and the control circuit board 2 is adopted to feed back corresponding light effect adjustment instruction; and then the power supply module 19 controls the light-emitting source 1 to output corresponding light effect according to the corresponding light effect adjustment instruction.

More specifically, the light-emitting source 1 further includes: a light source unit, in which the light source unit preferably adopts an LED as a light source; light source paths formed by LED light sources of multiple colors are combined to form a mixed light array by utilization of RGB and RGBW light mixing mode; the functions of dimming and color mixing can be achieved by adoption of the power supply module 19 to control the start and the brightness of the light source paths of multiple colors; and hence the required light effect can be simulated and obtained.

FIGS. 6-9 and FIGS. 10-13 respectively illustrate the illuminating device provided with a reflected light color acquiring module 100 in different embodiments.

As shown in FIGS. 6-9, in an embodiment, the reflected light color acquiring module 100 includes: a housing 101, a PCB 102 accommodated in the housing 101, an optical lens 103 and a color detector 104 assembled on one side of the PCB 102, and a connector 105 assembled on the other side of the PCB 102.

Detailed description will be given below to elements in the reflected light color acquiring module 100 in the preferred embodiment.

Figure 6:
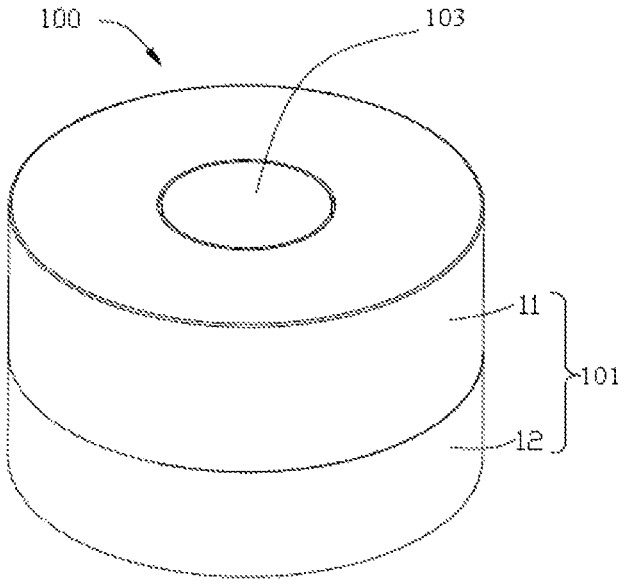
FIG. 6 is a perspective assembly diagram of a reflected light color acquiring module in a preferred embodiment of the present disclosure.
Figure 7:
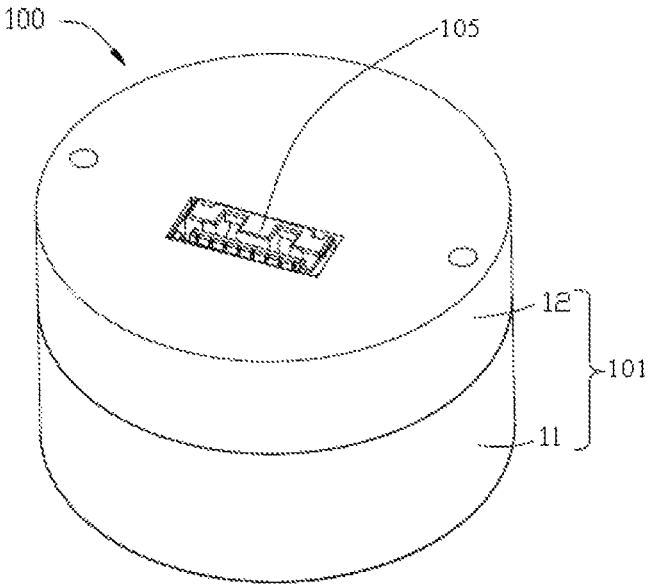
FIG. 7 is a perspective assembly diagram of the reflected light color acquiring module in the preferred embodiment of the present disclosure from another view.
Figure 8:
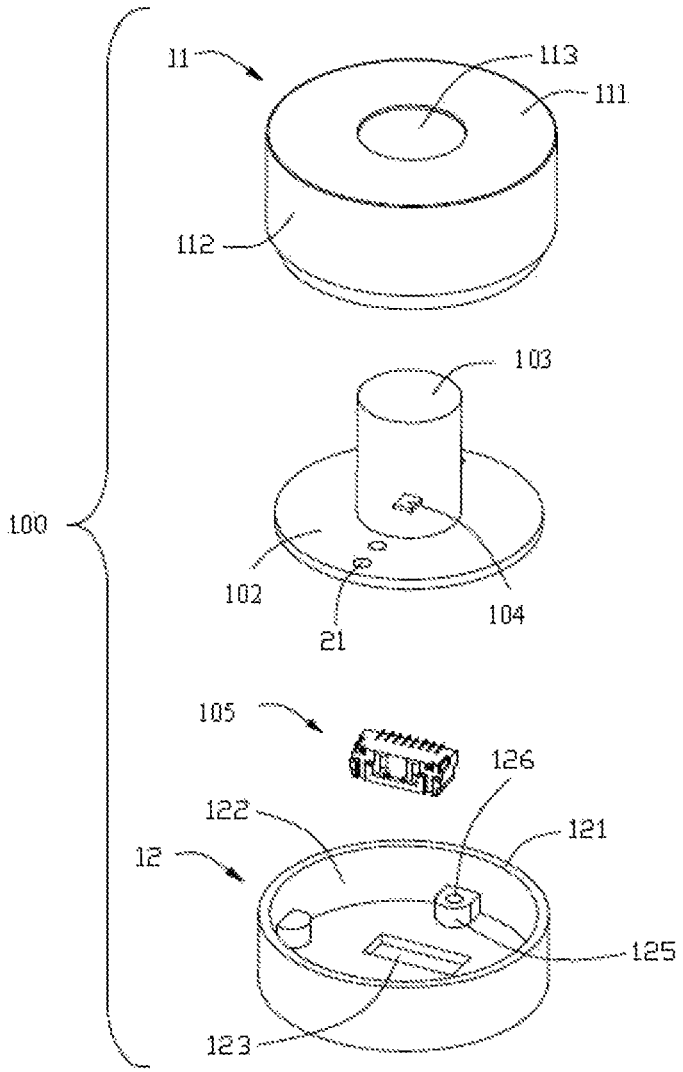
FIG. 8 is a perspective exploded view of FIG. 6.
Figure 9:
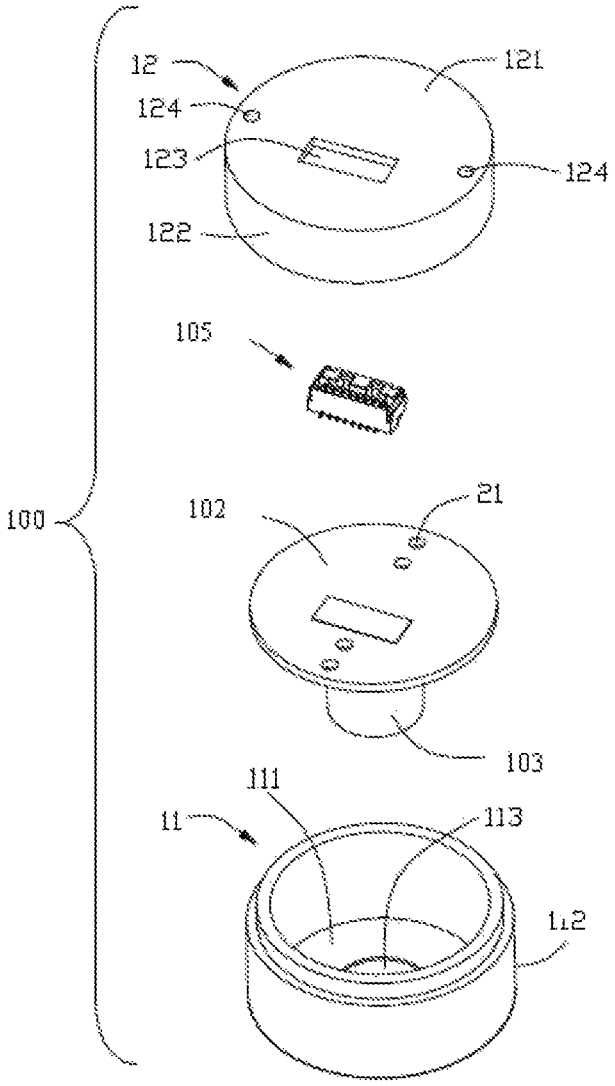
FIG. 9 is a perspective exploded view of FIG. 7.

As shown in FIGS. 6, 8 and 9, the housing 101 is made of insulating material(s) and includes a first cover body 11 and a second cover body 12 assembled together. The first cover body 11 includes a circular top wall 111 and a first side wall 112 extended from a side surface of the top wall 111. The top wall 111 of the first cover body 11 is provided with a first through hole 113 through which the lens 3 is exposed, and the first through hole 113 is circular. The second cover body 12 includes a bottom wall 121 and a second side wall 122 extended from a side surface of the bottom wall 121. The bottom wall 121 of the second cover body 12 is provided with a second through hole 123 through which the connector 105 is exposed, and two mounting holes 124 for the reflected light color acquiring module 100 to be rapidly mounted on the illuminating device (not shown), and the second through hole 123 is rectangular. The second cover body 12 is also provided with a plurality of supporting blocks 125 disposed on an interface of the bottom wall 121 and the second side wall 122, in which at least two supporting blocks 125 are respectively provided with screw holes. The first cover body 11 and the second cover body 12 can be fastened together by the threaded connection between the first side wall 112 and the second side wall 122.

As shown in FIGS. 8 and 9, the PCB 102 is circular and is disposed on the plurality of supporting blocks 125 in the second cover body 12. Positioning holes 21 are formed on and run through the PCB 2. The PCB 102 and the second cover body 12 may be positioned by bolts (not shown).

As shown in FIGS. 6, 8 and 9, the optical lens 103 is cylindrical, and one end of the optical lens is accommodated in and extended to the first through hole 113, so that the optical lens can receive external light. The main functions of the optical lens 103 include: collecting light within a specific range according to different specifications of the selected optical lens; and adjusting the intensity of light reaching a surface of the color detector 104, in which the light travels through the optical lens.

The color detector 104 may be a color sensor, or a spectral detector. The color detector 104 is fixed on the PCB 102 and disposed between the optical lens 103 and the PCB 102. The external light arrives at the surface of the color detector 104 after travelling through the optical lens 103. The color detector 104 collects the reflected light of the illuminated object and outputs proper electric parameters according to the reflected light; and color information is obtained after the signal processing of the obtained electrical parameters, namely surface color information of the illuminated object is obtained. It should be noted that the color information includes the relative intensity of R, G, and B components. The RGB color mode is a color standard in the industry, which obtains a variety of colors by the variation of three RGB channels and the superposition of each other. R, G, and B represent the colors of the three R, G, and B channels.

The connector 105 may be bonded on the PCB 102 by surface mount technology (SMT).

The reflected light color acquiring module 100 in the preferred embodiment is assembled by the following steps. The specific steps include:

assembling the optical lens 103, the color detector 104 and the connector 105 on the PCB 102, and forming an assembly; and assembling the above assembly and fixing the assembly on the second cover body 12; and assembling the first cover body 11 on the second cover body.

By the above steps, the reflected light color acquiring module 100 is assembled.

As shown in FIGS. 10-13, in another embodiment, a reflected light color acquiring module 100' includes: a housing 101', a PCB 102' accommodated in the housing 101', an optical lens 103' and a color detector 104' assembled on one side of the PCB 102', and a connector 105' assembled on the other side of the PCB 102'. The reflected light color acquiring module 100' further includes a first fastener 106' assembled on the housing 101'. The illuminating device includes a second fastener 107' cooperating with the first fastener 106' in a locking manner.

Detailed description will be given below to the elements in the reflected light color acquiring module 100' in the preferred embodiment.

Figure 10:
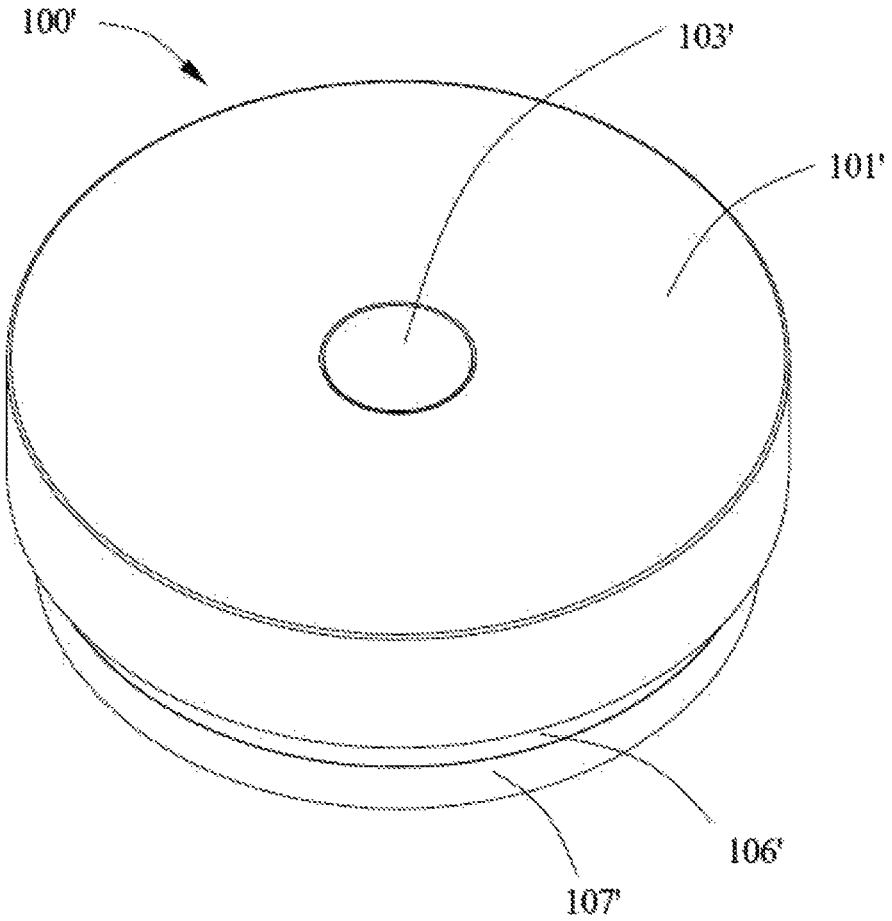
FIG. 10 is a perspective assembly diagram of a reflected light color acquiring module in another preferred embodiment of the present disclosure.
Figure 11:
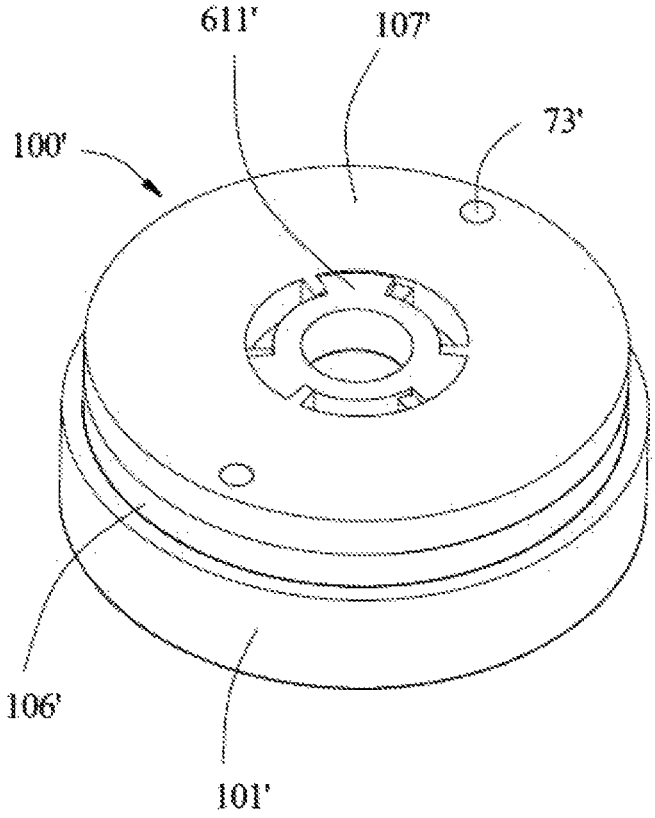
FIG. 11 is a perspective assembly diagram of the reflected light color acquiring module in another preferred embodiment of the present disclosure from another view.
Figure 12:
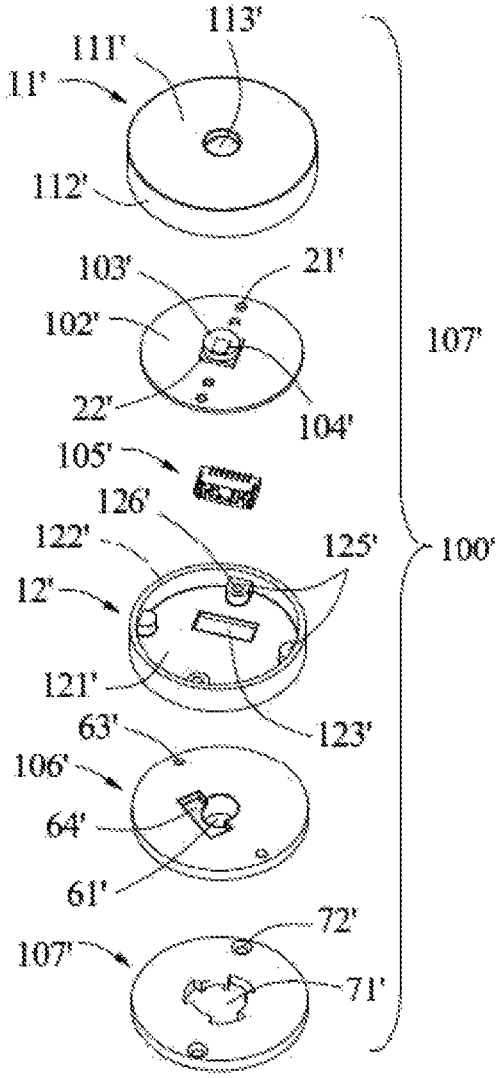
FIG. 12 is a perspective exploded view of FIG. 10.
Figure 13:
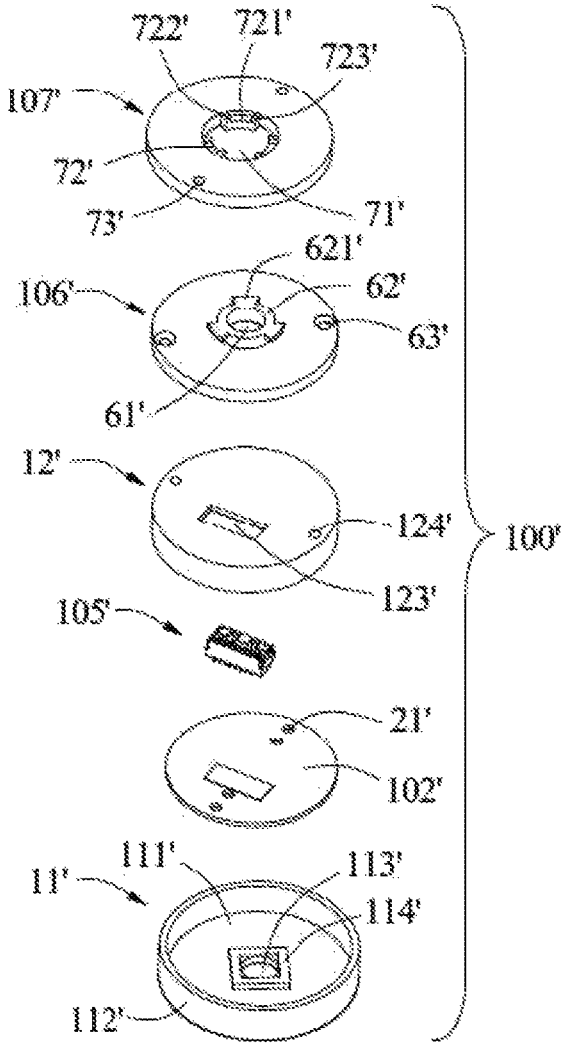
FIG. 13 is a perspective exploded view of FIG. 11.

As shown in FIGS. 10, 12 and 13, the housing 101' is made of insulating material(s) and includes a first cover body 11' and a second cover body 12' assembled together. The first cover body 11' includes a circular top wall 111' and a first side wall 112' extended from a side surface of the top wall 111'. The top wall 111' of the first cover body 11' is provided with a first through hole 113' through which the optical lens 103' is exposed, and the first through hole 113' is circular. The lens 103' can be communicated with the outside via the first through hole 113'. The inner surface of the top wall 111' is also provided with a rectangular ring rib 114'. The rib 114' is disposed around the first through hole 113'. The second cover body 12' includes a bottom wall 121' and a second side wall 122' extended from a side surface of the bottom wall 121'. The bottom wall 121' of the second cover body 12' is provided with a second through hole 123' through which the connector 105' is exposed, and two mounting holes 124', and the second through hole 123' is rectangular. The connector 105' may be communicated with the outside of the housing 101' via the second through hole 123'. The second cover body 12' is also provided with a plurality of supporting blocks 125' disposed on an interface of the bottom wall 121' and the second side wall 122', in which at least two supporting blocks 125' are respectively provided with screw holes 126'. The first cover body 11' and the second cover body 12' are fastened together by the threaded connection between the first side wall 112' and the second side wall 122'.

The PCB 102' is circular and is disposed on the plurality of supporting blocks 125' in the second cover body 12'. Positioning holes 21' are formed on and run through the PCB 102'. The PCB 102' includes a positioning block 22'. The PCB 102' and the second cover body 12' can be positioned by bolts (not shown). The positioning block 22' is accommodated in an accommodating space (not marked) formed by the rectangular ring rib 114', so as to position the PCB 102' and the first cover body 11'.

The optical lens 103' is cylindrical and is disposed on the positioning block 22' of the PCB 102'. The optical lens 103' is accommodated in and extended to the first through hole 113'. The main functions of the optical lens 103' include: collecting light within a specific range according to different specifications of the selected optical lens 103', for instance, collecting ambient light, or light emitted by an object; and adjusting the intensity of light travelling through the optical lens 103' and reaching a surface of the color detector 104'.

The color detector 104' can be a color sensor, or a spectral detector. The color detector 104' is fixed on the PCB 102' and disposed between the optical lens 103' and the PCB 102'. The external light arrives at the surface of the color detector 104' after travelling through the optical lens 103'. The color detector 104' collects the reflected light of the illuminated object and outputs proper electric parameters according to the reflected light; and color information is obtained after the signal processing of the obtained electrical parameters, namely surface color information of the illuminated object is obtained. It should be noted that the color information includes the relative intensity of R, G, and B components, namely chromaticity coordinate points of the colors. The RGB color mode is a color standard in the industry, which obtains a variety of colors by the variation of three RGB channels and the superposition of each other. R, G, and B represent the colors of the three RGB channels.

The connector 105' can be bonded on the PCB 102' by surface mount technology (SMT).

The first fastener 106' is circular and is provided with a through hole 61', a recess 64' communicated with the through hole 61', and two screw holes 63'. The through hole 61' is disposed in the center of the first fastener 106', and the recess 64' is disposed on a surface contacting the second cover body 12'. The other surface of the first fastener 106' is provided with a tubular positioning part 62', and a locking block 621' is disposed on the positioning part 62'. The first fastener 106' can be fastened on the second cover body 12' by bolts (not marked).

The reflected light color acquiring module 100' in the preferred embodiment of the present disclosure is assembled by the following steps, and the specific steps include:

assembling the optical lens' 103, the color detector 104' and the connector 105' on the PCB 102', and forming an assembly; and assembling the above assembly and fixing the assembly on the second cover body 12'; assembling the first cover body 11' on the second cover body 12'; and assembling the first fastener 106' on the second cover body 12'.

By the above steps, the reflected light color acquiring module 100' is assembled.

As the reflected light color acquiring module 100' is provided with a fastener, namely the first fastener 106', the reflected light color acquiring module 100' can be rapidly mounted on the illuminating device.

A second fastener 107' on the illuminating device provided by the preferred embodiment is circular and is provided with a locking hole 71' for accommodating the positioning part 62' on the first fastener 106', and three stop blocks 72' disposed in the locking hole 71'. Each stop block 72' is provided with a depressed part 721' and ribs 722' and 723' disposed on two sides of the depressed part 721'. The height of the rib 723' is less than the height of the rib 722'.

The positioning part 62' of the second fastener 107' is rotated for a certain angle after being accommodated into the locking hole 71', so that the locking block 621' can be accommodated into the depressed part 721' after passing over the lower rib 723' on the stop block 72'. Due to the limitation of the ribs 722' and 723', the second fastener 107' is stably fixed on the first fastener 106'. The second fastener 107' is mounted on the illuminating device. The through hole 61' and the locking hole 71' allow a connecting line to run through.

The reflected light color acquiring module 100' and the illuminating device can be rapidly connected by the fastening cooperation of the first fastener 106' and the second fastener 107'.

In an embodiment of the present disclosure, the required irradiating light may also be customized according to specific illumination requirement, for instance, irradiating light with a preset color is provided for certain garment, so as to obtain unique outstanding effect with distinctive personal features. The control system provided by the embodiment of the present disclosure may still be adopted to allow the irradiating light to be gradually close to the foregoing customized irradiating light, as long as the adjusting target of the irradiating light is preset only to be the customized irradiating light. No further description will be given here As can be seen from the technical proposals of the embodiments of the present disclosure, in the embodiments of the present disclosure, the next detection light is obtained according to reflected light of the previous detection light. When the color difference of reflected light of the previous detection light and the next detection light is less than a preset color difference range, the illuminating device is controlled to project the next detection light to an illuminated object. In this way, no matter how the color of the illuminated object changes, or even the color change is very subtle, a detection light of which the color is mostly coordinated with the illuminated object can also be automatically obtained to illuminate the object continuously.

The objective of the embodiments of the present disclosure may be to provide an illuminating device, a control method thereof and a control system thereof, which may precisely adjust the color of emitted irradiating light according to the color of an object.

To achieve this objective, a control method of an illuminating device is provided, which may include:

controlling the illuminating device to project initial detection light to an illuminated object, in which the initial detection light is in an initial color;

acquiring a color of initial reflected light generated by the illuminated object on the basis of the initial detection light;

acquiring a target color according to the color of the initial reflected light;

controlling the illuminating device to project target detection light to the illuminated object, in which the target detection light is in a target color;

acquiring a color of target reflected light generated by the illuminated object on the basis of the target detection light; and determining whether the color difference between the initial reflected light and the target reflected light is within a preset color difference range, or not, if yes, controlling the illuminating device to keep projecting the target detection light.

Furthermore, the initial color is white.

Furthermore, the acquiring of the target color according to the color of the initial reflected light specifically includes:

acquiring a chromaticity coordinate value of the initial reflected light;

obtaining a target chromaticity coordinate value by a conversion of the chromaticity coordinate value of the initial reflection spectrum with a preset weighting coefficient; and obtaining the target color according to the target chromaticity coordinate value.

Furthermore, the obtaining of the target chromaticity coordinate value by the conversion of the chromaticity coordinate value of the initial reflection spectrum with the preset weighting coefficient specifically includes:

acquiring a target illumination mode, in which the target illumination mode is one of a preset light sharing mode and a preset light filling mode;

obtaining the target chromaticity coordinate value by increasing the chromaticity coordinate value of the initial reflection spectrum with the preset weighting coefficient, when the target illumination mode is the preset light sharing mode; and obtaining the target chromaticity coordinate value by decreasing the chromaticity coordinate value of the initial reflection spectrum with the preset weighting coefficient, when the target illumination mode is the preset light filling mode.

Furthermore, the controlling of the illuminating device to project the target detection light to the illuminated object, in which the color of the target detection light is the target color, specifically includes:

obtaining a target pulse width modulation (PWM) signal, or a target drive current value according to the target color; and controlling the illuminating device to project the target detection light to the illuminated object according to the target PWM signal, or the target drive current value.

Furthermore, the control method may include:

updating the initial color according to the acquired target color, and returning to the step of controlling the illuminating device to project the initial detection light to the illuminated object, in which the initial detection light is in the initial color, when the color difference between the initial reflected light and the target reflected light is not within the preset range.

Furthermore, the updating of the initial color according to the acquired target color specifically includes:

adjusting the initial color to be the same as the target color.

Furthermore, the preset color difference range includes: the difference between the chromaticity coordinate value of the initial reflected light and the chromaticity coordinate value of the target reflected light is less than, or equal to 0.001.

To achieve the above objective, a control system of an illuminating device is provided. The control system may include:

an emission control circuit for controlling the illuminating device to project initial detection light to the illuminated object, in which the initial detection light is in an initial color;

a reflected light color acquiring circuit for acquiring a color of initial reflected light generated by the illuminated object on the basis of the initial detection light;

a target color acquiring circuit for acquiring a target color according to the color of the initial reflected light;

the emission control circuit for controlling the illuminating device to project target detection light to the illuminated object, in which the color of the target detection light is the target color;

the reflected light color acquiring circuit being used for acquiring a color of target reflected light generated by the illuminated object on the basis of the target detection light;

a color difference determining circuit for determining whether the color difference between the initial reflected light and the target reflected light is within a preset color difference range; and the emission control circuit for controlling the illuminating device to keep projecting the target detection light when the color difference between the initial reflected light and the target reflected light is within the preset color difference range.

Furthermore, the initial color is white.

Furthermore, the target color acquiring circuit specifically includes:

a chromaticity coordinate value acquiring sub-circuit for acquiring a chromaticity coordinate value of the initial reflected light;

a chromaticity coordinate value weighting sub-circuit for obtaining a target chromaticity coordinate value by a conversion of the chromaticity coordinate value of the initial reflection spectrum with a preset weighting coefficient; and a chromaticity coordinate value converting sub-circuit for obtaining the target color according to the target chromaticity coordinate value.

Furthermore, the chromaticity coordinate value weighting sub-circuit is specifically used for:

acquiring a target illumination mode, in which the target illumination mode is one of a preset light sharing mode and a preset light filling mode;

obtaining the target chromaticity coordinate value by increasing the chromaticity coordinate value of the initial reflection spectrum with the preset weighting coefficient, when the target illumination mode is the preset light sharing mode; and obtaining the target chromaticity coordinate value by decreasing the chromaticity coordinate value of the initial reflection spectrum with the preset weighting coefficient, when the target illumination mode is the preset light filling mode.

Furthermore, the emission control circuit is specifically used for:

obtaining a target PWM signal, or a target drive current value according to the target color; and controlling the illuminating device to project the target detection light to the illuminated object according to the target PWM signal, or the target drive current value.

Furthermore, the control system may include:

a color updating circuit for updating the initial color according to the acquired target color when the color difference between the initial reflected light and the target reflected light is not within the preset range.

Furthermore, the color updating circuit is specifically used for:

adjusting the initial color to be the same as the target color.

Furthermore, the preset color difference range includes: the difference between the chromaticity coordinate value of the initial reflected light and the chromaticity coordinate value of the target reflected light is less than or equal to 0.001.

To achieve the above objective, an illuminating device is provided. The illuminating device may include:

a light-emitting source;

a power drive unit for adjusting the power supplied for the light-emitting source; and the control system as the previously described, in which the control system is electrically connected with the light-emitting source, the drive unit and a power supply.

Furthermore, the illuminating device further may include: a color recognition circuit which is integrated onto the illuminating device and used for being cooperated with the reflected light color acquiring circuit to acquire the color of the reflected light generated by the illuminated object on the basis of the initial detection light and the target detection light, and it includes: a housing, a printed circuit board (PCB) accommodated in the housing, and a color detector mounted on one side of the PCB.

Furthermore, the reflected light color acquiring circuit further includes a connector mounted on the other side of the PCB and connected to the illuminating device, the connector being extended to the outside of the housing and communicated with the outside of the housing.

Furthermore, the reflected light color acquiring circuit further includes a first fastener mounted on the housing; and the illuminating device may include a second fastener; the first fastener and the second fastener being connected in a locking manner.

Furthermore, the color recognition circuit is disposed adjacent to the light-emitting source and detects the color of the illuminated object towards the illuminating direction of the light-emitting source.

Furthermore, the illuminating device may include a lamp body, both the reflected light color acquiring circuit and the light emitting source being accommodated in the lamp body.

Furthermore, the color recognition circuit further includes a first fastener mounted on the housing; and the illuminating device may include a second fastener; the first fastener and the second fastener being connected in a locking manner.

Furthermore, the illuminating device is a self-adapting spotlight and further may include a reflecting shade, a transmitting shade and a lamp body, in which the reflecting shade covers the light-emitting source and is expanded out towards the light exiting direction of the light-emitting source; and the transmitting shade covers a light outlet of the reflecting shade.

As can be seen from the present disclosure, a next detection light is obtained according to reflected light of a previous detection light, and when the color difference of reflected light of the previous detection light and the next detection light is less than a preset color difference range, the illuminating device is controlled to project the next detection light to an illuminated object. In this way, no matter how the color of the illuminated object changes, or even the color change is very subtle, a detection light of which the color is mostly coordinated with the illuminated object can also be automatically obtained to illuminate the object continuously.

The present disclosure may include dedicated hardware implementations such as application specific integrated circuits, programmable logic arrays and other hardware devices. The hardware implementations can be constructed to implement one or more of the methods described herein. Applications that may include the apparatus and systems of various examples can broadly include a variety of electronic and computing systems. One or more examples described herein may implement functions using two or more specific interconnected hardware modules or devices with related control and data signals that can be communicated between and through the modules, or as portions of an application-specific integrated circuit. Accordingly, the computing system disclosed may encompass software, firmware, and hardware implementations. The terms "module," "sub-module," "unit," or "sub-unit" may include memory (shared, dedicated, or group) that stores code or instructions that can be executed by one or more processors.

The foregoing is only the embodiments of the present disclosure and not intended to limit the present disclosure. Various changes and variations may be made by an ordinary skill in the art. Any modification, equivalent replacement, improvement, or the like made within the spirit and the principle of the present disclosure shall fall within the scope of the claims of the present disclosure.

What is claimed is:

1. A control method of an illuminating device, comprising:

controlling the illuminating device to project initial detection light to an illuminated object, in which the initial detection light is in an initial color;

acquiring a color of initial reflected light generated by the illuminated object on the basis of the initial detection light;

acquiring a target color according to the color of the initial reflected light;

controlling the illuminating device to project target detection light to the illuminated object, in which the target detection light is in the target color;

acquiring a color of target reflected light generated by the illuminated object on the basis of the target detection light; and determining whether a color difference between the initial reflected light and the target reflected light is within a preset color difference range or not, if yes, controlling the illuminating device to keep projecting the target detection light.

2. The control method according to claim 1, wherein acquiring of the target color according to the color of the initial reflected light comprises:

acquiring a chromaticity coordinate value of the initial reflected light;

obtaining a target chromaticity coordinate value by a conversion of the chromaticity coordinate value of the initial reflection spectrum with a preset weighting coefficient; and obtaining the target color according to the target chromaticity coordinate value.

3. The control method according to claim 2, wherein obtaining the target chromaticity coordinate value by the conversion of the chromaticity coordinate value of the initial reflection spectrum with the preset weighting coefficient comprises:

acquiring a target illumination mode, in which the target illumination mode is one of a preset light sharing mode and a preset light filling mode;

obtaining the target chromaticity coordinate value by increasing the chromaticity coordinate value of the initial reflection spectrum with the preset weighting coefficient, when the target illumination mode is the preset light sharing mode; and obtaining the target chromaticity coordinate value by decreasing the chromaticity coordinate value of the initial reflection spectrum with the preset weighting coefficient, when the target illumination mode is the preset light filling mode.

4. The control method according to claim 1, wherein controlling the illuminating device to project the target detection light to the illuminated object, in which the color of the target detection light is the target color, comprises:

obtaining a target pulse width modulation (PWM) signal, or a target drive current value according to the target color; and controlling the illuminating device to project the target detection light to the illuminated object according to the target PWM signal, or the target drive current value.

5. The control method according to claim 1, further comprising:

updating the initial color according to the acquired target color, and returning to the step of controlling the illuminating device to project the initial detection light to the illuminated object, in which the initial detection light is in the initial color, when the color difference between the initial reflected light and the target reflected light is not within the preset range.

6. The control method according to claim 5, wherein updating the initial color according to the acquired target color comprises:

adjusting the initial color to be the same as the target color.

7. The control method according to claim 1, wherein the preset color difference range comprises: the difference between the chromaticity coordinate value of the initial reflected light and the chromaticity coordinate value of the target reflected light is less than, or equal to 0.001.

8. A control system of an illuminating device, comprising:

an emission control circuit for controlling the illuminating device to project initial detection light to a illuminated object, in which the initial detection light is in an initial color;

a reflected light color acquiring circuit for acquiring a color of initial reflected light generated by the illuminated object on the basis of the initial detection light;

a target color acquiring circuit for acquiring a target color according to the color of the initial reflected light;

the emission control circuit further being used for controlling the illuminating device to project target detection light to the illuminated object, in which the color of the target detection light is the target color;

the reflected light color acquiring circuit further being used for acquiring a color of target reflected light generated by the illuminated object on the basis of the target detection light;

a color difference determining circuit for determining whether the color difference between the initial reflected light and the target reflected light is within a preset color difference range; and the emission control circuit further being used for controlling the illuminating device to keep projecting the target detection light when the color difference between the initial reflected light and the target reflected light is within the preset color difference range.

9. The control system according to claim 8, wherein the target color acquiring circuit comprises:

a chromaticity coordinate value acquiring sub-circuit for acquiring a chromaticity coordinate value of the initial reflected light;

a chromaticity coordinate value weighting sub-circuit for obtaining a target chromaticity coordinate value by a conversion of the chromaticity coordinate value of the initial reflection spectrum with a preset weighting coefficient; and a chromaticity coordinate value converting sub-circuit for obtaining the target color according to the target chromaticity coordinate value.

10. The control system according to claim 9, wherein the chromaticity coordinate value weighting sub-circuit is used for:

acquiring a target illumination mode, in which the target illumination mode is one of a preset light sharing mode and a preset light filling mode;

obtaining the target chromaticity coordinate value by increasing the chromaticity coordinate value of the initial reflection spectrum with the preset weighting coefficient, when the target illumination mode is the preset light sharing mode; and obtaining the target chromaticity coordinate value by decreasing the chromaticity coordinate value of the initial reflection spectrum with the preset weighting coefficient, when the target illumination mode is the preset light filling mode.

11. The control system according to claim 8, wherein the emission control circuit is used for:

obtaining a target PWM signal, or a target drive current value according to the target color; and controlling the illuminating device to project the target detection light to the illuminated object according to the target PWM signal, or the target drive current value.

12. The control system according to claim 8, wherein the control system comprises:

a color updating circuit for updating the initial color according to the acquired target color when the color difference between the initial reflected light and the target reflected light is not within the preset range.

13. The control system according to claim 12, wherein the color updating circuit is used for:

adjusting the initial color to be the same as the target color.

14. The control system according to claim 8, wherein the preset color difference range comprises: the difference between the chromaticity coordinate value of the initial reflected light and the chromaticity coordinate value of the target reflected light is less than or equal to 0.001.

15. An illuminating device, comprising:

a light-emitting source;

a power drive unit for adjusting the power supplied for the light-emitting source; and a control system that is electrically connected with the light-emitting source and the drive unit, wherein the control system comprises:

an emission control circuit for controlling the illuminating device to project initial detection light to the illuminated object, in which the initial detection light is in an initial color;

a reflected light color acquiring circuit for acquiring a color of initial reflected light generated by the illuminated object on the basis of the initial detection light;

a target color acquiring circuit for acquiring a target color according to the color of the initial reflected light;

the emission control circuit being used for controlling the illuminating device to project target detection light to the illuminated object, in which the color of the target detection light is the target color;

the reflected light color acquiring circuit being used for acquiring a color of target reflected light generated by the illuminated object on the basis of the target detection light;

a color difference determining circuit for determining whether the color difference between the initial reflected light and the target reflected light is within a preset color difference range; and the emission control circuit being used for controlling the illuminating device to keep projecting the target detection light when the color difference between the initial reflected light and the target reflected light is within the preset color difference range.

16. The illuminating device according to claim 15, further comprising a color recognition circuit which is integrated onto the illuminating device and used for being cooperated with the reflected light color acquiring circuit to acquire the color of the reflected light generated by the illuminated object on the basis of the initial detection light and the target detection light, and the reflected light color acquiring circuit comprises a housing, a printed circuit board (PCB) accommodated in the housing, and a color detector mounted on one side of the PCB.

17. The illuminating device according to claim 16, wherein the reflected light color acquiring circuit further comprises a connector mounted on the other side of the PCB and connected to the illuminating device, the connector being extended to the outside of the housing and communicated with the outside of the housing.

18. The illuminating device according to claim 16, wherein the color recognition circuit further comprises a first fastener mounted on the housing; and the illuminating device comprises a second fastener; the first fastener and the second fastener being connected in a locking manner.

19. The illuminating device according to claim 15, wherein the reflected light color acquiring circuit further comprises a first fastener mounted on the housing; and the illuminating device comprises a second fastener; the first fastener and the second fastener being connected in a locking manner.

20. The illuminating device according to claim 15, wherein the illuminating device is a self-adapting spotlight and further comprises a reflecting shade, a transmitting shade and a lamp body, in which the reflecting shade covers the light-emitting source and is expanded out towards the light exiting direction of the light-emitting source; and the transmitting shade covers a light outlet of the reflecting shade.

* * * * *